United States Patent [19]

Takada

[11] Patent Number: 4,892,627

[45] Date of Patent: Jan. 9, 1990

[54] METHOD OF NICKEL-TUNGSTEN-SILICON CARBIDE COMPOSITE PLATING

[75] Inventor: Koji Takada, Nagoya, Japan

[73] Assignee: Takada Laboratories, Inc., Japan

[21] Appl. No.: 344,226

[22] Filed: Apr. 27, 1989

[30] Foreign Application Priority Data

Feb. 18, 1989 [JP] Japan ..... Hei 1-37330

[51] Int. Cl.[4] ..... C25D 15/00

[52] U.S. Cl. ..... 204/16

[58] Field of Search ..... 204/16

[56] References Cited

U.S. PATENT DOCUMENTS 3,904,490 9/1975 Shigeru ..... 204/16

*Primary Examiner*—T. M. Tufariello

*Attorney, Agent, or Firm*—Kane, Daisimer, Sullivan, Kurucz, Levy, Eisele and Richard

[57] ABSTRACT

Disclosed is a method of nickel-tungsten-silicon carbide composite plating which comprises the steps of: preparing a plating bath having the following composition;

| | |
|---|---|
| nickel sulfate | 0.12–0.16 mol/L |
| sodium tungstate | 0.17–0.23 mol/L |
| ammonium citrate | 0.30–0.50 mol/L |
| pH | 6.0–8.0 |
| bath temperature | 60–80 |

dispersing fine powder of silicon carbide having a grit size of 0.8–1.5 μm in the plating bath with a concentration of 20–60 g/L; and causing electrolysis in the plating bath while mechanically agitating the plating bath, with a cathode current density of 10–30 A/dm$^2$ by use of a stainless steel plate as an anode.

1 Claim, No Drawings

METHOD OF NICKEL-TUNGSTEN-SILICON CARBIDE COMPOSITE PLATING

BACKGROUND OF THE INVENTION

1. Field of the Invention

The present invention relates to a hard plating method for the purpose of giving abrasion resistance to the sliding surfaces of mechanical parts or the like.

2. Description of the Prior Art

As such abrasion-resistance hard plating, generally, hard chromium plating has been performed. Hard chromium plating however has a defect in that if it is exposed to a high temperature not lower than 400° C., it is softened to lose its abrasion resistance. That is, although hard chromium plating has Micro Vickers hardness of Hv. 800–1000 at a room temperature, if it is exposed at a temperature of 600° C. for an hour, its hardness becomes low to Hv. 400 or less so that it loses its abrasion resistance. In order to improve such a defect, recently, various hard plating methods have been developed.

For example, composite plating in which fine powder of silicon carbide is contained as co-deposition in electroless nickel-phosphorous alloy plating has been put into practical use. The hardness and abrasion resistance of the composite plating is however not sufficient. Nickel-tungsten alloy plating has been known as precipitation hardenable alloy plating which is hardened through heat treatment. That is, this nickel-tungsten alloy plating has hardness of Hv. 600, and if the nickel-tungsten alloy plating is heat-treated at 400° C. for an hour, the hardness thereof becomes Hv. 1150 at maximum. The nickel-tungsten alloy plating however has a defect in that the internal stress thereof is so high that large cracks may occur in the plating layer if the plating is performed thickly, resulting in a problem in practical use.

SUMMARY OF THE INVENTION

It is therefore an object of the present invention to solve the problems in the prior art as described above.

It is another object of the present invention to provide a hard plating method, which can be industrially put into practical use, and in which the hardness of a material after plated is equal to that of hard chromium, further higher hardness can be obtained through heat treatment, the hardness and abrasion resistance do not become low at a high temperature, and in which such a defect as cracking or the like never occurs in the plating layer in the the plating step.

As the result of eager studies to solve the foregoing problems in the prior art and to develop a heat-resistant hard plating method which can be industrially put into practical use, the inventor of this application has found that if nickel-tungsten-silicon carbide composite plating is obtained by performing electrolytic plating in an ammonium citrate type nickel-tungsten alloy plating bath under limited conditions while fine power of silicon carbide having a grain size of 0.8–1.5 μm is dispersed to float in the bath, the nickel-tungsten-silicon carbide composite plating has hardness equal to that of hard chromium plating in a room temperature, and if the nickel-tungsten-silicon carbide composite plating is subject to heat treatment at 400° C. for an hour, extremely high hardness of Hv. 1700 at maximum can be obtained. Thus, the inventor has completed the present invention by establishing a method in which a novel hard plating which is superior in heat-resistant hardness at a high temperature and which has abrasion resistance several times as high as that of hard chromium can be easily and economically obtained.

The present invention will be described more in detail hereunder.

DETAILED DESCRIPTION OF THE INVENTION

The plating bath for use according to the present invention is an ammonium citrate type nickel-tungsten alloy plating bath. It is known that a variety of nickel-tungsten alloy plating having various compositions can be obtained by use of this plating bath. In order to obtain nickel-tungsten alloy plating which can satisfy the objects of the present invention, however, the composition of the plating bath and the plating conditions are limited to those shown below as the results of experiments and studies in a wide range performed by the inventor of the present application.

| | |
|---|---|
| Nickel sulfate (hexahydrate) | 0.12–0.16 mol/L |
| Sodium tungstate (dihydrate) | 0.17–0.23 mol/L |
| Ammonium citrate (monohydrate) | 0.30–0.50 mol/L |
| pH | 6.0–8.0 |
| Bath temperature | 60–80° C. |
| Cathode current density | 10–30 A/dm$^2$ |

With respect to an anode, a stainless steel plate such as of the type 304 stainless steel or the like is preferably used as an insoluble anode.

Metals consumed by electrolysis is supplemented by adding nickel hydroxide and tungstic acid into the plating bath.

The plating bath composition and the plating conditions in the range described above is a first constituent feature of the present invention.

If plating is performed under the conditions described above, nickel-tungsten alloy plating containing tungsten of 44–50% is electrodeposited, and the hardness of the plating film is Hv. 650–750. The plating film has a characteristic that if the plating film is subject to heat treatment at a temperature of 400° C., the hardness thereof rises to Hv. 1200–1300. Since the hardness of this plating is however Hv. 650–750 as plated condition, this plating is inferior to hard chromium plating the hardness of which is Hv. 800–1000. Accordingly, this plating is inferior in hardness as well as in abrasion resistance to the conventional hard chromium if this plating is used without being subject to heat treatment. According to the present invention, in order to achieve the objects thereof, electrolytic plating is performed while fine powder of silicon carbide is dispersed to float in the plating bath described above to thereby obtain composite plating in which a nickel-tungsten alloy and silicon carbide are contained as co-deposition.

With respect to the hard fine powder material to be contained as co-deposition in the nickel-tungsten alloy plating, the inventor of this application performed experiments and examinations on basic materials in a wide range, for example, carbide such as tungsten carbide, nitride such as boron nitride, artificial diamond, and so on, and as the results, it was confirmed that silicon carbide is particularly suitable for achieving the objects of the present invention. As the results of the experiments, it was also confirmed that the most suitable value of the grit size of the fine powder was 0.8–1.5 μm. That is, to perform electrolytic plating while dispersing fine powder of silicon carbide having a grit size of 0.8–1.5 μm to float in the above-mentioned plating bath is a second constituent feature of the present invention. As to the agitating method for dispersing the fine powder of silicon carbide to float in the plating bath, generally, air bubbling agitation and mechanical agitation may be available. As the results of the above experiments, however, the inventor of this application also confirmed the fact that it was hard to obtain homogeneous composite plating by air bubbling agitation. To use mechanical agitation is therefore a third constituent feature of the present invention.

The nickel-tungsten-silicon carbide composite plating according to the present invention obtained by the method satisfying the constituent features described above contains 5–10% silicon carbide in a nickel-tungsten alloy matrix of 50–56% nickel and 44–50% tungsten, and shows characteristics that the hardness after plating is Hv. 850–1000 at a room temperature which is equal to that of the conventional hard chromium, and that if the plating is subject to heat treatment at a temperature of 400° C. for an hour, the plating exhibits extremely high hardness of Hv. 1500–1700 and the hardness and abrasion resistance of the plating are not lowered at a high temperature.

More in detail, the above-mentioned constituent features are described as follows. That is, if the plating bath composition defined as the first constituent feature is not maintained, the hardness of the plating film may become insufficient or defects such as cracking or flaking may be caused in the plating film. As to the grit size of the fine power of silicon carbide defined as the second constituent feature, if the grit size is not larger than 0.8 μm, the hardness and abrasion resistance of the plating film unsuitably become insufficient, while if the grit size is not smaller than 1.5 μm, the surface roughness of the plating film unsuitably becomes large. As to the method of agitation of the plating bath defined as the third constituent feature, in the case of use of the method of air bubbling agitation, the external appearance and performance of the plating film unsuitably become heterogeneous. It is therefore one of the conditions to employ the method of mechanical agitation.

A first meritorious effect of the present invention is in that a hard plating film having high hardness and high abrasion resistance can be obtained. Although the hardness of Hv. 850–1000 of the plating film at a room temperature after plating according to the present invention was equal to that of the conventional hard chromium plating, Taber abrasion test showed that the abrasion resistance of the same was superior to that of the conventional hard chromium plating. If the hard plating film according to the present invention was subject to heat treatment at a temperature of 400° C. for an hour, the hardness thereof was raised to Hv. 1500–1700, and in the Taber test, the abrasion resistance thereof showed a value three or more times as high as that of the hard chromium plating. According to the present invention, it is therefore possible to obtain a novel hard plating film capable of showing higher hardness and higher abrasion resistance at a high temperature on the contrary to the conventional hard chromium plating having a defect in that its hardness and abrasion resistance become low at a high temperature.

A second meritorious effect of the present invention is in that owing to the high current efficiency of the plating bath according to the present invention, it is possible to obtain a high deposition rate which is three or more times that in the conventional hard chromium plating, and it is therefore possible to perform thick plating in a short time. This meritorious effect makes the time taken for plating work short and makes the economic effect extremely high.

A third meritorious effect of the present invention is in that the hard plating film according to the present invention is extremely superior in corrosion resistance in comparison with the conventional hard chromium plating. The hard plating film according to the present invention is superior particularly in acid resistance. For example, in an immersion test by use of 15% hydrochloric acid, the plating film according to the present invention showed corrosion resistance 100 or more times as high as that of the hard chromium plating film.

A fourth meritorious effect of the present invention is in that the internal stress of the plating film according to the present invention is so low that cracking or flaking never occurs even in thick plating. Nickel-tungsten alloy plating generally has a defect that the internal stress is so high that cracking may occur to cause flaking of the plating film in the case of thick plating. In the plating according to the present invention, however, it is considered that the stress is dispersed and reduced by the fine particles of silicon carbide existing as codeposition so that the generation of cracking or flaking is suppressed even in the case of thick plating.

The plating according to the present invention has advantages in that it is so superior in throwing power that the workability is remarkably improved in comparison with the hard chromium plating which is poor in throwing power.

A fifth meritorious effect of the present invention is in that the plating bath contains no toxic substance such as hexavalent chromium contained in a chromium plating bath, and the characteristic of the plating solution is neutral in pH so that the plating solution is low in pollution problems and has no problem in labor safety.

The present invention will be described more in detail hereunder with respect to an example thereof.

EXAMPLE

Plating Bath Composition and Plating Conditions

| | |
|---|---|
| $NiSO_4.6H_2O$ | 0.130 mol/L |
| $Na_2WO_4.2H_2O$ | 0.210 mol/L |
| $C_6H_5O_7(NH_4)_3.H_2O$ | 0.470 mol/L |
| SiC (average grit size 1 μm) | 50 g/L |
| pH (adjusted by ammonium hydroxide and citric acid) | 7.0 |
| bath temperature | 70° C. |
| cathode current density | 20 A/dm$^2$ |
| anode | Type 304 stainless plate |
| agitation method | mechanical agitation by use of a propeller type agitator |
| cathode (substrate to be plated) | mild steel panel |
| plating time | 30 minutes |

By the plating work under the above plating conditions with the above plating bath composition, mat and smooth nickel-tungsten-silicon carbide composite plating having 55 μm thickness was obtained.

Quantitative analysis was made on the thus obtained plating film by use of an EPMA (electron probe micro analyzer), and the flowing result of analysis was obtained.

| | |
|---|---|
| Ni | 46.32% |
| W | 46.14% |
| Si | 4.31% |
| C | 3.20% |

From the above result of analysis, it was found that the plating contains silicon carbide of about 7.5%. Further, as the result of observation of the section of the plating with a microscope, it was found that the fine powder of silicon carbide was uniformly dispersed in a nickel-tungsten alloy matrix.

The hardness of the plating film was measured by means of a Micro Vickers hardness tester and the results showed the hardness of Hv. 910. The plating was heat-treated in an electric furnace at a temperature of 400° C. for an hour and the hardness thereof was measured after cooled. The hardness showed Hv. 1650.

Abrasion resistance test was performed, by use of a Taber abrasion tester, on test specimens of the nickel-tungsten-silicon carbide composite plating which were obtained in the above experiment according to the present without being subject to heat treatment and after being subject to heat treatment at 400° C. for an hour respectively and on a comparative test specimens of a steel panel coated with 50 μm hard chromium plating, under the test conditions that the amount of abrasion was measured after 10000 cycles of abrasion test with a load of 1000 g by use of a CS-17 wheel. The results of the abrasion resistance test are as follows.

| | |
|---|---|
| Nickel-tungsten-silicon carbide composite plating according to the present invention (not heat-treated) | 17.6 mg |
| Nickel -tungsten-silicon carbide composite plating according to the present invention (after heat-treated) | 6.4 mg |
| conventional hard chromium plating | 23.8 mg |

As results of the above test, it was proved that the nickel-tungsten-silicon carbide composite plating according to the present invention can show, even if it is not heat-treated, abrasion resistance which is superior to that of the conventional hard chromium plating, and it can show, when it is heat-treated, abrasion resistance three times as high as that of the hard chromium plating.

Further, a steel plate test specimen coated with the nickel-tungsten-silicon carbide composite plating according to the present invention to 50 μm thick and a steel plate comparative test specimen coated with hard chromium plating to =μm thick were immersed into hydrochloric acid of 15 volume % concentration at a room temperature. In the case of the comparative test specimen coated with the hard chromium plating, the plating film was completely dissolved and lost after an hour. On the other hand, in the case of the test specimen coated with the nickel-tungsten-silicon carbide composite plating, the plating film was not dissolved at all even after the dipping time of 120 hours.

This experiment proves that the nickel-tungsten-silicon carbide composite plating is superior in acid resistance.

COMPARATIVE EXAMPLE

A comparative example was examined under the following conditions where the constituent features of the present invention were not maintained.

Plating Bath Composition and Plating Conditions

| | |
|---|---|
| $NiSO_4.6H_2O$ | 0.17 mol/L |
| $Na_2WO_4.2H_2O$ | 0.16 mol/L |
| $C_6H_5O_7(NH_4)_3.H_2O$ | 0.29 mol/L |
| SiC (average grit size 0.5 μm) | 15 g/L |
| pH | 8.5 |
| bath temperature | 55° C. |
| cathode current density | 8 A/dm$^2$ |
| anode | Type 304 Stainless plate |
| agitation method | air agitation |
| cathode (plating substrate) | mild steel panel |
| plating time | 30 minutes |

By the plating work under the above plating conditions with the above plating bath composition, plating having a 43 μm thick plating film was obtained. However, visible cracking was generated in the surface of the plating and flaking of plating was partly recognized. The hardness of the plating film was Hv. 680 which was inferior even to that of the conventional hard chromium plating. The abrasion test could not be carried out because of existence of the cracking and flaking caused in the plating film.

As described above in the Examples, the present invention provides a method of obtaining novel hard plating which has high hardness and high abrasion resistance and which exhibits higher hardness and higher abrasion resistance when it is exposed to a high temperature. The present invention can be carried out industrially and is a significant one in view of industry.

What is claimed is:

1. A method of nickel-tungsten-silicon carbide composite plating comprising the steps of:

preparing a plating bath having the following composition;

| | |
|---|---|
| nickel sulfate | 0.12–0.16 mol/L |
| sodium tungstate | 0.17–0.23 mol/L |
| ammonium citrate | 0.30–0.50 mol/L |
| pH | 6.0–8.0 |
| bath temperature | 60–80 |

dispersing fine powder of silicon carbide having a grit size of 0.8–1.5 μm in said plating bath with a concentration of 20–60 g/L; and causing electrolysis in said plating bath while mechanically agitating said plating bath, with a cathode current density of 10–30 A/dm$^2$ by use of a stainless steel plate as an anode.

* * * * *